US006099339A

United States Patent [19]

Yanagida et al.

[11] Patent Number: 6,099,339

[45] Date of Patent: Aug. 8, 2000

[54] CONNECTOR PLUG-LOCKING MECHANISM

[75] Inventors: Yasuhiro Yanagida; Mitsuhiro Yoshida; Koji Hisada; Koji Togashi, all of Tokyo, Japan

[73] Assignee: SMK Corporation, Tokyo, Japan

[21] Appl. No.: 09/106,660

[22] Filed: Jun. 29, 1998

[30] Foreign Application Priority Data

Nov. 27, 1997 [JP] Japan ..... 9-342032

[51] Int. Cl.[7] ..... H01R 13/627

[52] U.S. Cl. ..... 439/358

[58] Field of Search ..... 439/358, 350, 439/352, 353, 354, 355, 356, 357, 351

[56] References Cited

U.S. PATENT DOCUMENTS 5,634,809 6/1997 Hirai ..... 439/352
5,797,771 8/1998 Garside ..... 439/610

FOREIGN PATENT DOCUMENTS 986626 9/1997 Japan .

*Primary Examiner*—Gary F. Paumen
*Assistant Examiner*—Alexander Gilman
*Attorney, Agent, or Firm*—Pearne, Gordon, McCoy & Granger LLP

[57] ABSTRACT

A lock mechanism by which a mating connector socket to be mounted on a printed wiring board of an electronic equipment can be formed into a small size, and even if the direction of mounting of the connector socket is inverted, or if the electronic equipment itself is turned upside down, the locking can be easily released. In a connector plug (10) for electrically connecting a mating connector socket (20), mounted on a printed wiring board of an electronic equipment, to another electronic equipment through an electric cable (30), when the connector plug (10) is fitted in the connector socket (20), this fitted condition is locked by a lock mechanism, and the lock mechanism of the connector plug includes retractable lock pawls (12) provided at a face side of a fitting portion (11) of a generally rectangular parallelepiped shape, and lock release buttons (14) provided respectively at opposite side surfaces of a finger grip portion (13).

5 Claims, 6 Drawing Sheets

CONNECTOR PLUG-LOCKING MECHANISM

BACKGROUND OF THE INVENTION

This invention relates to a connector plug-locking mechanism for locking the fitting of a connector plug in a mating connector socket.

A conventional locking mechanism of a connector plug as disclosed in Japanese Design Registration No. 986226 includes retractable lock pawls provided respectively at opposite side surfaces of a fitting portion having a generally rectangular parallelepiped shape, and by engaging these lock pawls respectively with lock portions of a mating connector socket, the connector plug can be locked to the connector socket, and when lock release buttons, provided respectively at opposite side surfaces of a finger grip portion of the connector plug, are pressed, the locking can be released.

However, since such locking mechanism has the lock pawls provided respectively at the opposite side surfaces of the fitting portion, the lock portions must be provided respectively at the opposite side surfaces of the connector socket, and therefore there has been encountered a problem that the connector socket has an increased dimension in the longitudinal direction.

SUMMARY OF THE INVENTION

It is an object of this invention to provide a connector plug which enables a small-size design of a connector socket to be mounted on a printed wiring board of an electronic equipment, and also can increase the degree of freedom with respect to the direction of mounting of the connector socket on the electronic equipment.

According to the present invention, there is provided a connector plug (10) for electrically connecting a mating connector socket (20), mounted on a printed wiring board of an electronic equipment, to another electronic equipment through an electric cable (30), wherein when the connector plug (10) is fitted in the connector socket (20), this fitted condition is locked by a lock mechanism; CHARACTERIZED in that the lock mechanism of the connector plug includes a retractable lock pawl (12) provided at a face side of a fitting portion (11) of a generally rectangular parallelepiped shape, and a lock release button (14) provided at a side surface of a finger grip portion (13).

In this construction, since the lock pawl 12 is provided only at the face side of the fitting portion 11, lock portions of the connector socket 20 to be mounted on the printed wiring board of the electronic equipment are provided only at a face of the connector socket 20, and therefore the mating connector socket 20 can be formed into a small size.

The lock release button 14 is provided at the side surface of the finger grip portion 13, and therefore even if the direction of mounting of the connector socket 20 on the electronic equipment is inverted (that is, the connector socket is turned upside down), or if the electronic equipment itself is turned upside down, the locking can be easily released since the lock release button 14 is provided at the side surface of the finger grip portion.

DETAILED DESCRIPTION OF THE PREFERRED EMBODIMENT

Figure 1:
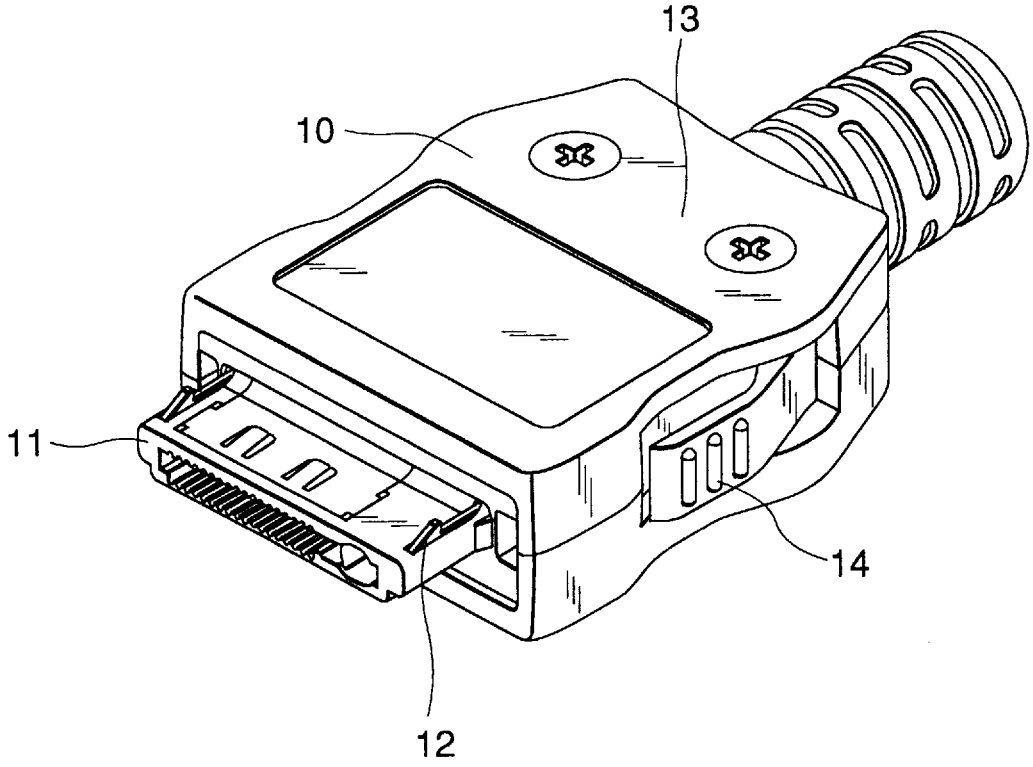
FIG. 1 is a perspective view of a connector plug of the present invention as seen from an upper side thereof.
Figure 2:
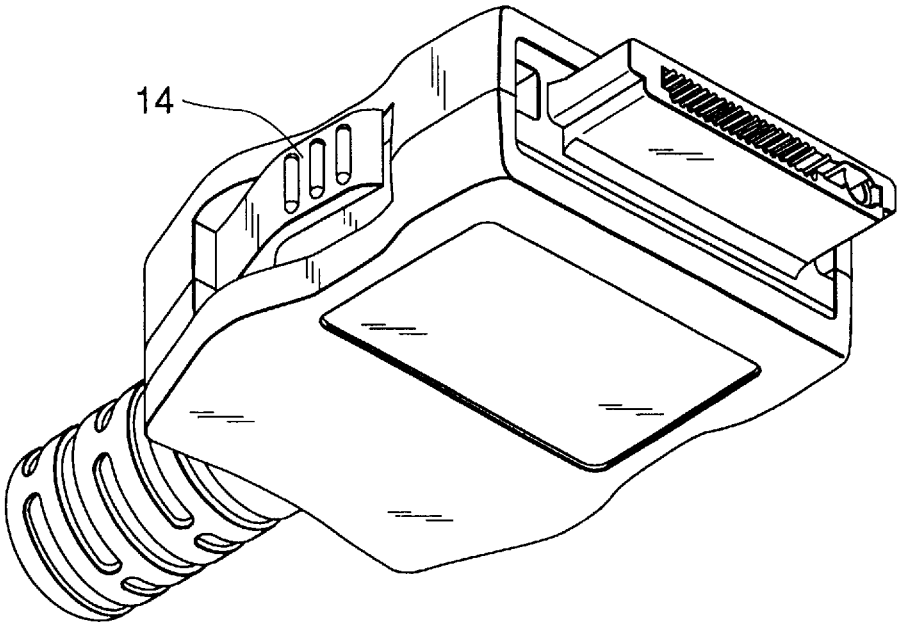
FIG. 2 is a perspective view thereof as seen from a bottom side thereof.
Figure 3:
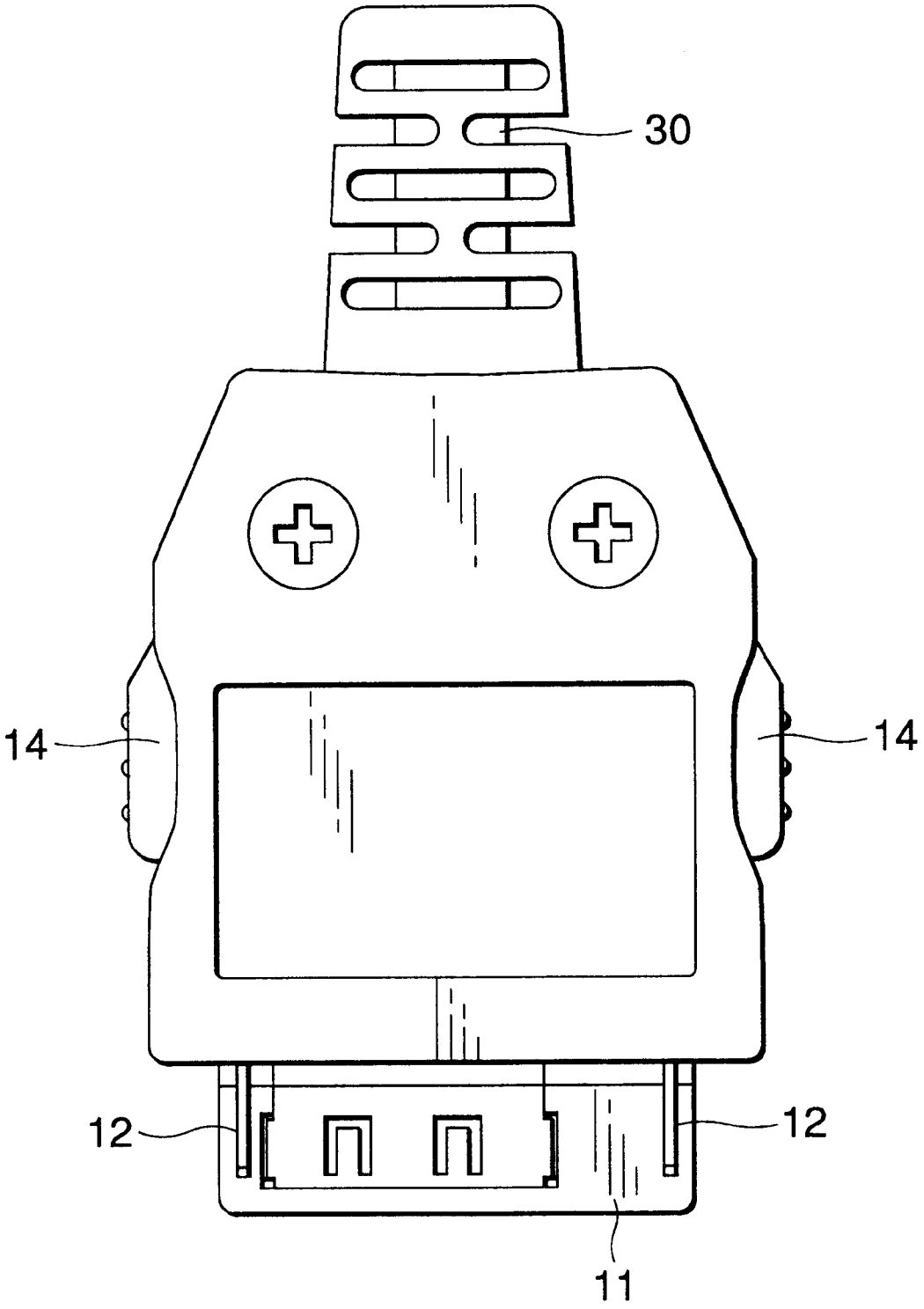
FIG. 3 is a plan view thereof.
Figure 4:
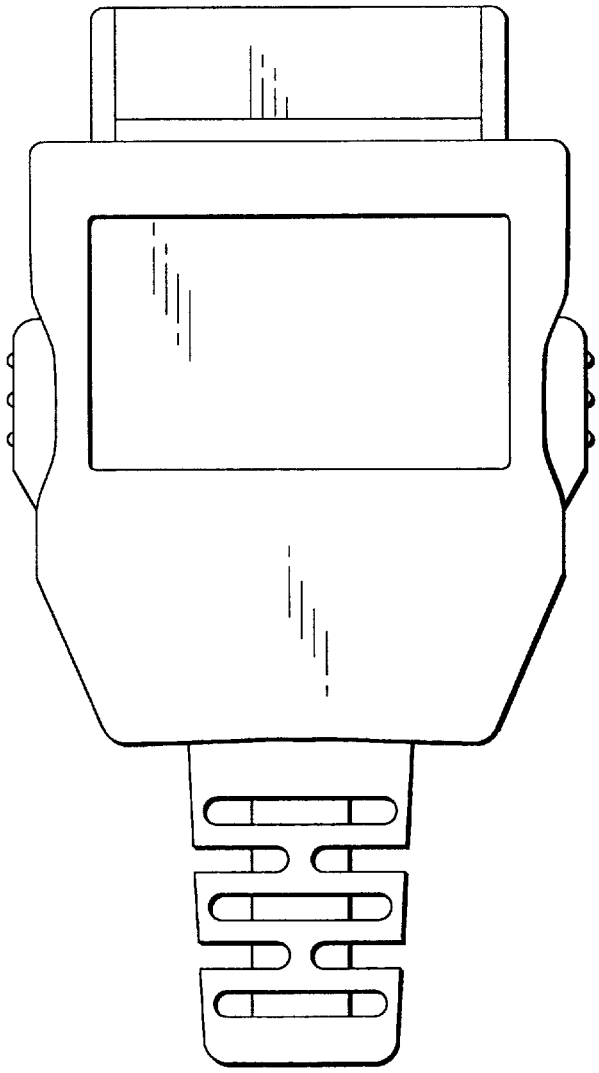
FIG. 4 is a bottom view thereof.
Figure 5:
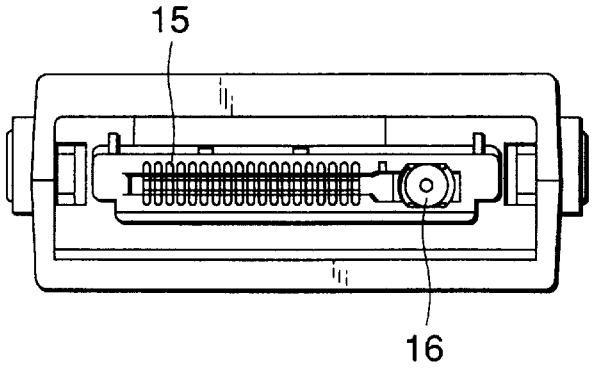
FIG. 5 is a front-elevational view thereof.
Figure 6:
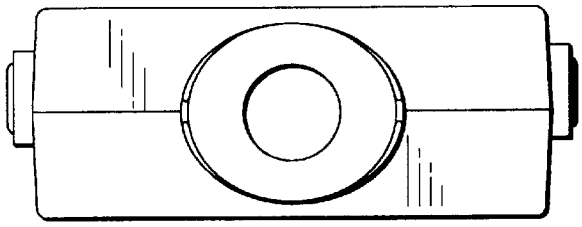
FIG. 6 is a rear view thereof.
Figure 7:
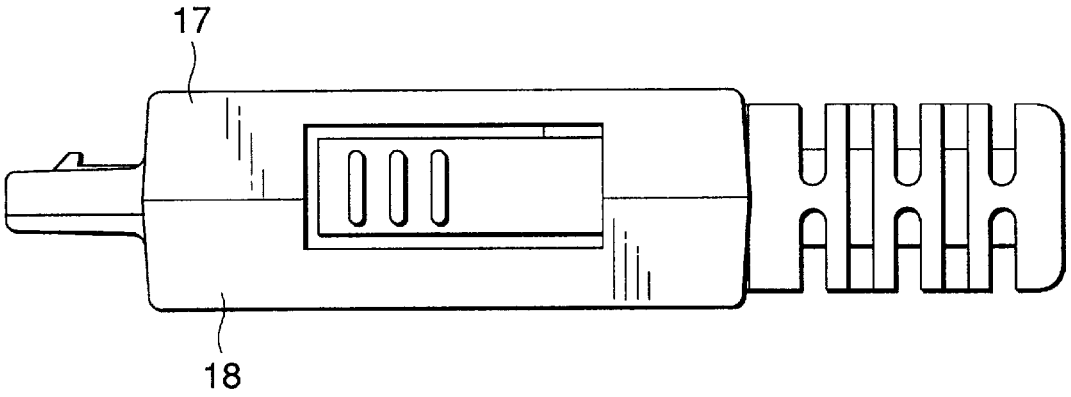
FIG. 7 is a right side-elevational view thereof.
Figure 8:
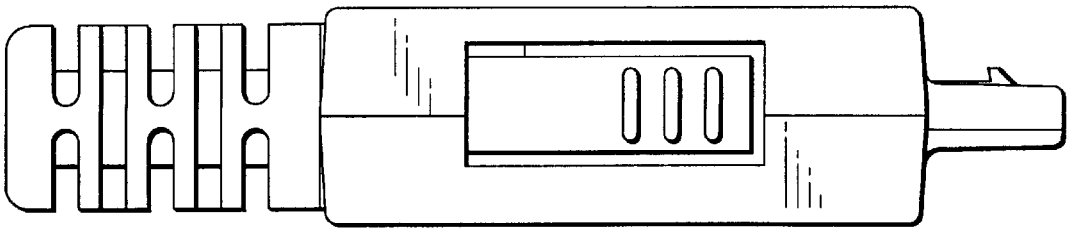
FIG. 8 is a left side-elevational view thereof.
Figure 9:
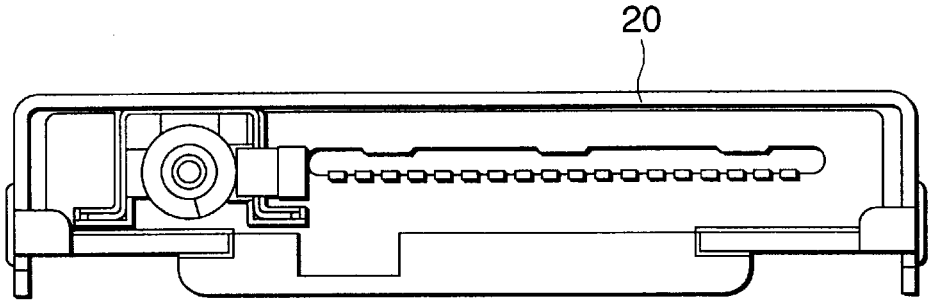
FIG. 9 is a front-elevational view of a mating connector socket.
Figure 10:
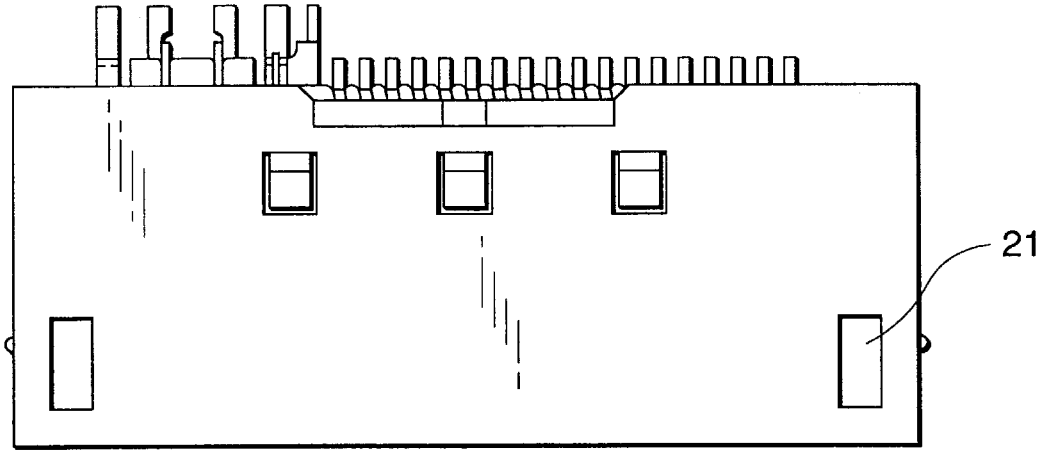
FIG. 10 is a plan view of the connector socket.
Figure 11:
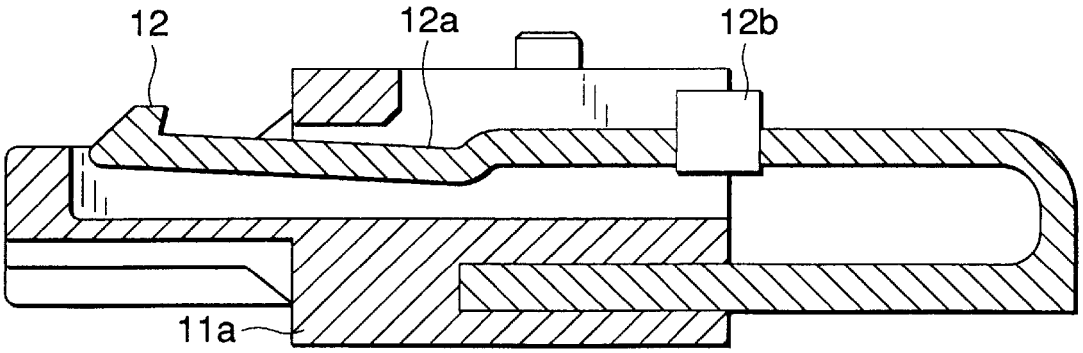
FIG. 11 is a view explanatory of the operation of a lock pawl.
Figure 12:
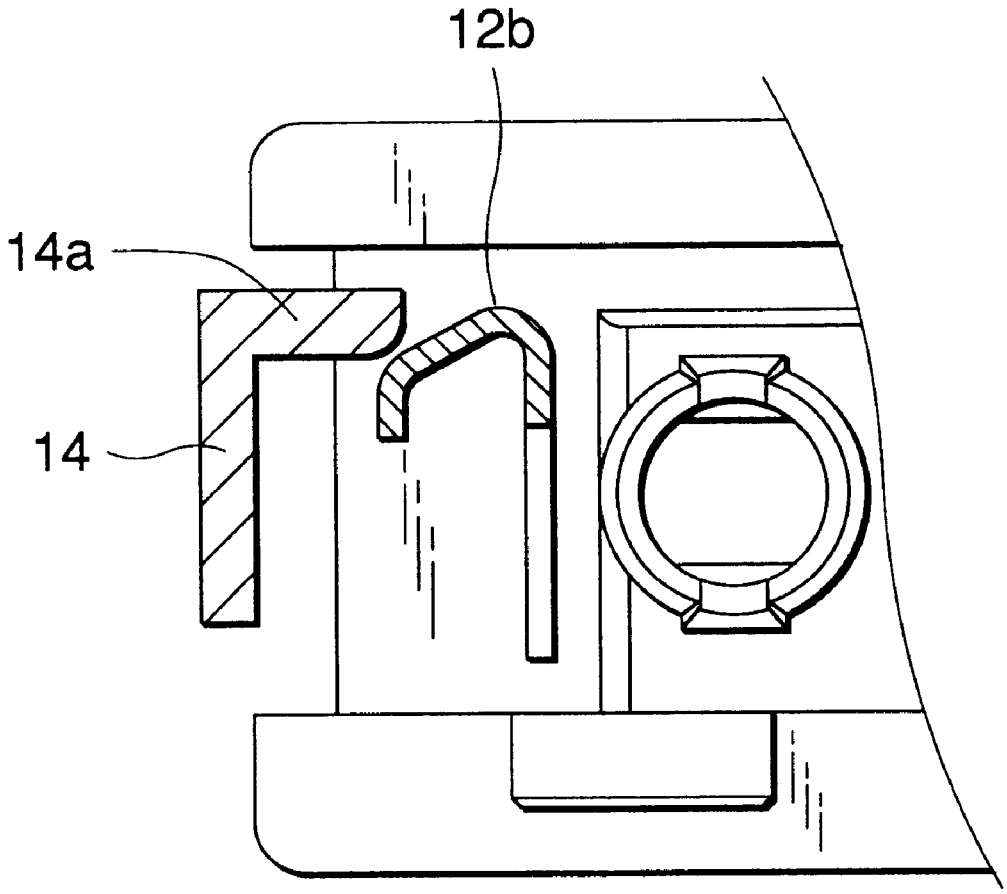
FIG. 12 is a view explanatory of the operation of the lock pawl.

A preferred embodiment of the present invention will now be described in detail with reference to the drawings. FIGS. 1 to 8 are a perspective view of a connector plug of the invention as seen from the upper side thereof, a perspective view of the connector plug as seen from the bottom side thereof, a plan view, a bottom view, a front-elevational view, a rear view, a right side-elevational view and a left side-elevational view, respectively. FIGS. 9 and 10 are respectively a front-elevational view and a plan view of a connector socket which is a mate to the connector plug of the invention. FIGS. 11 and 12 are views explanatory of the operation of a lock pawl.

The connector plug 10 comprises a fitting portion 11 of a generally rectangular parallelepiped shape which holds the lock pawls 12, a plurality of contacts 15 and a coaxial contact plug 16, a finger grip portion 13 which holds the fitting portion 11, and comprises an upper case 17, a lower case 18 and lock release buttons 14, and an electric cable 30.

The fitting portion 11 includes a housing 11a molded of an engineering plastics material, and has the plurality of contacts 15 (each made of an electrically-conductive material) and the coaxial contact plug 16 held in the housing 11*a* by press-fitting or the like, and the lock pawls 12 are retractably held at a face side of the fitting portion 11. The face side used in this specification means a surface of the fitting portion 11 appearing in FIG. 3 (an upper surface of the fitting portion 11 in FIG. 1).

The contacts 15 and the coaxial contact plug 16 are electrically connected respectively to their corresponding conductors in the electric cable 30 by soldering or the like.

As shown in FIG. 11, the lock pawl 12 is formed at one end of a lock piece 12*a* comprising a resilient metal piece formed into a generally J-shape, and the other end of the lock piece 12*a* is press-fitted and held in the housing 11*a*. As shown in FIG. 12, that arm portion of the lock piece 12*a*, having the lock pawl 12, has an operating portion 12*b* formed intermediate opposite ends thereof, and this operating portion 12*b* is bent to be slanting toward the lock release button 14. With this construction, when the lock release button 14 is pressed, a pressing portion 14*a* of the lock release button 14 gradually depresses the slanting portion of the operating portion 12*b*, so that the lock pawl 12 is moved in a lock-release direction (that is, downwardly in FIG. 11), thereby releasing the locking. In this embodiment, although the two lock pieces 12*a* are provided respectively at opposite ends of the face side, only one lock piece 12*a* may be provided at one of the opposite ends, in which case the lock release button 14 is provided at one of the opposite side surfaces of the finger grip portion 13. The lock pawls 12 of this construction are engaged respectively in lock portions 21 formed in one face of the connector socket 20 (shown in FIG. 10), thereby locking the connector plug 10 to the connector socket 20.

The upper case 17 and the lower case 18 each having a frame-like shape is molded of an engineering plastics material, and the two cases 17 are 18 are fitted together to form the finger grip portion 13.

The finger grip portion 13 holds the housing 11*a* having the fitting portion 11, and within the finger grip portion 13, the contacts 15 and the coaxial contact plug 16 are electrically connected to the electric cable 30.

As shown in FIGS. 11 and 12, the lock pieces 12*a*, each having the operating portion 12*b* slanting toward the pressing portion 14*a* of the associated lock release button 14, are held in the finger grip portion 13.

The lock release buttons 14 are mounted respectively at the opposite side surfaces of the finger grip portion 13, and can be pressed. As described above, when the lock release buttons 14 are pressed, the locking is released.

Since the lock pawls 12 are provided only at the face side of the fitting portion 11, the lock portions 21 of the connector socket 20 to be mounted on a printed wiring board of an electronic equipment are provided only at the face of the connector socket 20, and therefore the mating connector socket 20 can be formed into a small size.

The lock release buttons 14 are provided respectively at the opposite side surfaces of the finger grip portion 13, and therefore even if the direction of mounting of the connector socket 20 on the electronic equipment is inverted (that is, the connector socket is turned upside down), or if the electronic equipment itself is turned upside down, the locking can be easily released since the lock release buttons 14 are provided respectively at the opposite side surfaces of the finger grip portion.

What is claimed is:

1. A connector plug (10) comprising a fiting portion and a finger grip portion, said connector plug being adapted for electrically connecting a mating connector socket (20), mounted on a printed wiring board of an electronic equipment, to another electronic equipment through an electric cable (30), wherein when said connector plug (10) is fitted in said connector socket (20), this fitted condition is locked by a lock mechanism, said lock mechanism of said connector plug including:

at least one retractable lock pawl (12) provided at a face side of the fitting portion (11) of a generally rectangular parallelepiped shape, and at least one lock release button (14) provided at a side surface of the finger grip portion (13), said finger grip portion side surface being generally perpendicular to said fitting portion face side, wherein the lock release button and the lock pawl move in directions perpendicular to each other.

2. A connector plug according to claim 1, wherein said at least one lock release button (14) includes two lock release buttons which are provided respectively at opposite side surfaces of said finger grip portion (13).

3. A connector plug according to claim 1, wherein said face side is an elongated surface of said fitting portion.

4. A connector plug (10) adapted to be connected to a mating connector socket (20) in a first direction, said connector comprising:

a fitting portion (11) in which a plurality of contacts (15) are installed;

a finger grip portion (13) holding said fitting portion (11), said finger grip portion (13) being elongated in said first direction;

at least one lock pawl (12) supported by said fitting portion (11) through a lock piece (12*a*) and protruded from said fitting portion (11), said lock pawl (12) being movable in a second direction perpendicular to said first direction so that said lock pawl (12) is operatively retracted into said fitting portion (11); and at least one lock release button (14) supported by said finger grip portion (13), said lock release button (14) being movable in a direction transverse to said first direction, movement of said lock release button being operable to retract said lock pawl (12) into said fitting portion (11) through an operating portion (12*b*) provided on said lock piece (12*a*), wherein the lock release button and the lock pawl move in directions perpendicular to each other.

5. A connector plug according to claim 4, wherein said operating portion (12*b*) defines a slanting surface facing a pressing portion (14*a*) of said lock release button (14), and said slanting surface of said operating portion (12*b*) converts movement of said lock release button (14) in said direction transverse to said first direction into movement of said lock pawl (12) in said second direction.

* * * * *